US010947940B2

(12) United States Patent
Nong

(10) Patent No.: US 10,947,940 B2
(45) Date of Patent: Mar. 16, 2021

(54) FUEL DELIVERY SYSTEM

(71) Applicant: Picospray, Inc., Ann Arbor, MI (US)

(72) Inventor: Lihang Nong, Ann Arbor, MI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 344 days.

(21) Appl. No.: 15/938,503

(22) Filed: Mar. 28, 2018

(65) Prior Publication Data

US 2018/0283332 A1 Oct. 4, 2018

Related U.S. Application Data

(60) Provisional application No. 62/477,835, filed on Mar. 28, 2017.

(51) Int. Cl.
*F02M 37/10* (2006.01)
*F04B 53/10* (2006.01)
(Continued)

(52) U.S. Cl.
CPC ..... *F02M 37/10* (2013.01); *F02M 37/043* (2013.01); *F02M 51/04* (2013.01);
(Continued)

(58) Field of Classification Search
CPC ..... F02M 37/043; F02M 37/10; F02M 51/04; F02M 69/02; F02M 69/50; F04B 17/046; F04B 53/1002
See application file for complete search history.

(56) References Cited

U.S. PATENT DOCUMENTS 3,293,516 A * 12/1966 Maier ..... F04B 17/046 318/128
4,116,591 A * 9/1978 Mardell ..... F02M 51/04 310/80
(Continued)

FOREIGN PATENT DOCUMENTS

CN 103119297 A 5/2013
CN 104956064 A 9/2015
(Continued)

OTHER PUBLICATIONS

Australia First Examination Report regarding Application No. 201334273 (6 pages).
(Continued)

*Primary Examiner* — Carl C Staubach
(74) *Attorney, Agent, or Firm* — Foley & Lardner LLP

(57) ABSTRACT

A fuel delivery system includes a fuel pump assembly, an extension tube, and an injection nozzle assembly. The fuel pump assembly includes a pumping chamber, an inlet valve configured to direct fuel to the pumping chamber, a piston configured to pressurize fuel in the pumping chamber, an electromagnetic actuator operatively coupled to the piston, and an outlet check valve configured to direct pressurized fuel out of the pumping chamber. The electromagnetic actuator is configured to produce a force sufficient to move the piston to pressurize fuel in the pumping chamber and direct pressurized fuel through the outlet check valve. The extension tube is located downstream of the outlet check valve, and the injection nozzle assembly is located downstream of the extension tube. The injection nozzle assembly includes a nozzle check valve configured to selectively permit pressurized fuel received from the outlet check valve through the extension tube to exit the fuel delivery system.

20 Claims, 7 Drawing Sheets

(51) Int. Cl.

| | |
|---|---|
| ***F02M 69/50*** | (2006.01) |
| ***F02M 37/04*** | (2006.01) |
| ***F04B 17/04*** | (2006.01) |
| ***F02M 69/02*** | (2006.01) |
| ***F02M 51/04*** | (2006.01) |

(52) U.S. Cl.
CPC ..... *F02M 69/02* (2013.01); *F02M 69/50* (2013.01); *F04B 17/046* (2013.01); *F04B 53/1002* (2013.01)

(56) References Cited

U.S. PATENT DOCUMENTS

| | | | | |
|---|---|---|---|---|
| 4,121,125 | A | 10/1978 | Dolz | |
| 4,327,695 | A | 5/1982 | Schechter | |
| 4,463,900 | A | 8/1984 | Wich | |
| 4,505,243 | A | 3/1985 | Miwa | |
| 4,552,311 | A * | 11/1985 | Casey | F02M 51/005 239/585.4 |
| 4,915,602 | A | 4/1990 | Tschopp | |
| 5,107,890 | A | 4/1992 | Gute | |
| 5,351,893 | A | 10/1994 | Young | |
| 5,390,257 | A | 2/1995 | Oslac et al. | |
| 5,419,492 | A | 5/1995 | Gant et al. | |
| 5,469,828 | A | 11/1995 | Heimberg et al. | |
| 5,472,323 | A | 12/1995 | Hirabayashi et al. | |
| 5,511,955 | A | 4/1996 | Brown et al. | |
| 5,630,401 | A | 5/1997 | Binversie et al. | |
| 5,704,771 | A | 1/1998 | Fujisawa et al. | |
| 5,781,363 | A | 7/1998 | Rowan et al. | |
| 5,898,786 | A | 4/1999 | Geisenberger | |
| 6,024,071 | A * | 2/2000 | Heimberg | F02D 41/20 123/490 |
| 6,081,112 | A | 6/2000 | Carobolante et al. | |
| 6,135,357 | A | 10/2000 | Herrin et al. | |
| 6,290,308 | B1 | 9/2001 | Zitzelsberger | |
| 6,373,957 | B1 | 4/2002 | Stewart | |
| 6,394,367 | B2 | 5/2002 | Munezane et al. | |
| 6,422,836 | B1 | 7/2002 | Krueger et al. | |
| 6,614,617 | B1 | 9/2003 | Galloway | |
| 6,640,787 | B2 * | 11/2003 | Hashimoto | F02M 51/04 123/499 |
| 6,796,290 | B2 | 9/2004 | Boehland et al. | |
| 6,877,489 | B2 * | 4/2005 | Hashimoto | F02M 51/04 123/514 |
| 6,877,679 | B2 | 4/2005 | Lawes | |
| 6,923,163 | B2 | 8/2005 | Yamazaki | |
| 6,964,263 | B2 | 11/2005 | Xi et al. | |
| 6,966,760 | B1 | 11/2005 | Radue | |
| 7,063,520 | B2 | 6/2006 | Oh et al. | |
| 7,100,578 | B2 * | 9/2006 | Yamazaki | F02D 41/065 123/499 |
| 7,150,606 | B2 * | 12/2006 | Bonfardeci | F04B 17/046 417/417 |
| 7,225,790 | B2 | 6/2007 | Bartunek | |
| 7,267,533 | B1 | 9/2007 | Tocci et al. | |
| 7,287,966 | B2 | 10/2007 | French et al. | |
| 7,309,025 | B2 | 12/2007 | Yamazaki et al. | |
| 7,377,266 | B2 | 5/2008 | Xi et al. | |
| 7,410,347 | B2 | 8/2008 | Radue | |
| 7,438,050 | B2 * | 10/2008 | Allen | F02D 41/009 123/436 |
| 7,484,673 | B2 | 2/2009 | Boecking | |
| 7,533,655 | B2 * | 5/2009 | Allen | F02D 41/009 123/436 |
| 7,753,657 | B2 | 7/2010 | Strauss et al. | |
| 7,798,130 | B2 * | 9/2010 | Allen | F02D 41/2096 123/436 |
| 7,866,144 | B2 | 1/2011 | Bakaj et al. | |
| 8,079,825 | B2 | 12/2011 | Bocchiola | |
| 9,500,170 | B2 * | 11/2016 | Nong | F02M 51/061 |
| 10,197,025 | B2 * | 2/2019 | Pitcel | F04B 17/03 |
| 10,330,061 | B2 * | 6/2019 | Nong | F02M 51/061 |
| 10,619,628 | B2 * | 4/2020 | Plisch | F04B 15/08 |
| 2003/0155444 | A1 | 8/2003 | Lawes | |
| 2005/0263135 | A1 | 12/2005 | Magel et al. | |
| 2006/0011735 | A1 | 1/2006 | Magel | |
| 2006/0097067 | A1 | 5/2006 | Buehler et al. | |
| 2007/0095934 | A1 | 5/2007 | Wisdom | |
| 2009/0108093 | A1 | 4/2009 | Mattes et al. | |
| 2010/0011578 | A1 | 1/2010 | Beck et al. | |
| 2010/0193611 | A1 | 8/2010 | Burger et al. | |
| 2010/0236526 | A1 | 9/2010 | Wang et al. | |
| 2010/0312453 | A1 | 12/2010 | Smither | |
| 2014/0117121 | A1 * | 5/2014 | Nong | F02M 51/061 239/584 |
| 2016/0186732 | A1 * | 6/2016 | Xi | F02M 51/04 417/415 |
| 2017/0067429 | A1 * | 3/2017 | Nong | F02M 61/162 |
| 2018/0030969 | A1 * | 2/2018 | Nong | F04B 17/044 |
| 2019/0136808 | A1 * | 5/2019 | Pitcel | F04B 17/03 |
| 2019/0285036 | A1 * | 9/2019 | Nong | F02M 61/02 |

FOREIGN PATENT DOCUMENTS

| | | |
|---|---|---|
| DE | 10 2008 005 647 A1 | 7/2009 |
| EP | 0 752 148 | 1/1997 |
| EP | 1 248 494 | 10/2002 |
| EP | 1 249 598 A2 | 10/2002 |
| EP | 1 367 225 | 12/2003 |
| EP | 1 832 739 A1 | 9/2007 |
| EP | 2 198 140 | 6/2010 |
| GB | 2 452 955 | 3/2009 |
| WO | WO-2014/066696 A1 | 5/2014 |

OTHER PUBLICATIONS

Corrected International Search Report and Written Opinion for Application No. PCT/US2013/066703, dated Jul. 28, 2014, 13 pages.

EP Extended Search Report dated May 17, 2016 regarding EP Application No. 13849666.6 (6 pgs.).

International Preliminary Report on Patentability completed Nov. 24, 2014 regarding Application No. PCT/US13/66703; 6 pgs.

International Search Report and Written Opinion dated Feb. 10, 2014 in relate PCT Application No. PCT/US2013/066703.

Chinese Office Action issued in corresponding application No. 201380055696.1 dated Dec. 5, 2016 with English Translation.

* cited by examiner

FUEL DELIVERY SYSTEM

CROSS-REFERENCE TO RELATED PATENT APPLICATIONS

This application claims the benefit of and priority to U.S. Provisional Application No. 62/477,835, filed Mar. 28, 2017, the entire disclosure of which is hereby incorporated by reference herein.

BACKGROUND

The present application relates generally to the field of internal combustion engines. More particularly, the present application relates to fuel injection systems for internal combustion engines.

Fuel injection systems can provide fuel to an internal combustion engine. A typical fuel injection system includes a pump and an injector. The pump provides pressurized fuel from a tank to the injector, and the injector meters the fuel into the air intake or combustion chamber. A typical fuel injector uses a solenoid or piezoelectric system to move a needle, thereby permitting or preventing flow of the pressurized fuel through the fuel injector to an outlet nozzle. Internal combustion engines using fuel injection systems typically have cleaner emissions than carbureted; however, in many small engines, and in many parts of the world, carburetors are still widely used due to the cost and complexity of fuel injection systems. Thus, there is a need for an improved fuel injection system. There is a further need for an improved low-cost fuel injection system.

SUMMARY

One embodiment of the present application relates to a fuel delivery system. The fuel delivery system includes a fuel pump assembly comprising a pumping chamber, an inlet valve configured to direct fuel to the pumping chamber, a piston configured to pressurize fuel in the pumping chamber, an electromagnetic actuator operatively coupled to the piston, and a pump outlet check valve configured to direct pressurized fuel out of the pumping chamber. The electromagnetic actuator is configured to produce a force sufficient to move the piston to pressurize fuel in the pumping chamber and direct pressurized fuel through the pump outlet check valve. The fuel delivery system further includes an extension tube located downstream of the pump outlet check valve and an injection nozzle assembly located downstream of the extension tube. The injection nozzle assembly includes a nozzle check valve configured to selectively permit pressurized fuel received from the pump outlet check valve through the extension tube to exit the fuel delivery system.

Another embodiment relates to a fuel delivery system. The fuel delivery system includes a fuel pump assembly, an extension tube, and an injection nozzle assembly. The fuel pump assembly includes a pumping chamber, an inlet valve configured to introduce fuel into the pumping chamber, a piston configured to pressurize fuel in the pumping chamber, an electromagnetic actuator configured to move the piston, and an outlet check valve for directing pressurized fuel out of the pumping chamber. The inlet valve is configured to be in an open position during an intake stroke of the piston to introduce fuel into the pumping chamber. The piston is configured to pressurize fuel in the pumping chamber during a pumping stroke of the piston to cause the outlet check valve to open and the inlet valve to close. The extension tube is located downstream of the outlet check valve, and the injection nozzle assembly includes a nozzle check valve located downstream of the extension tube. The extension tube and the nozzle check valve are configured to direct pressurized fuel received from the outlet check valve into an intake of an engine.

Another embodiment relates to a fuel delivery system. The fuel delivery system includes a fuel pump assembly comprising a pumping chamber, an inlet valve configured to introduce fuel into the pumping chamber, a piston configured to pressurize fuel in the pumping chamber, and an outlet check valve configured to direct pressurized fuel out of the pumping chamber. The fuel delivery system further includes an extension tube located downstream of the outlet check valve, and an injection nozzle assembly including a nozzle check valve located downstream of the extension tube. The extension tube and the nozzle check valve are configured to direct pressurized fuel received from the outlet check valve into an intake of an engine.

In some exemplary embodiments, the fuel pump assembly may be located near the bottom of a fuel tank. The injection nozzle assembly may be located near the intake or head of an engine and positioned to direct fuel into the engine intake or head.

In some exemplary embodiments, the fuel pump assembly may be insulated by an air jacket or according to another embodiment the fuel pump assembly may be immersed in a pocket of fuel at the bottom of the fuel tank.

In some exemplary embodiments, the electromagnetic actuator may include a coil, stator, and an armature. The magnetic actuator may include a radial and axial gap between the armature and the stator on the same end of the armature. The magnetic field may pass through both the radial and axial gap with the field going through the radial gap becoming stronger as the axial gap is reduced. The magnetic actuator may provide a relatively constant force through its intended range of travel.

DETAILED DESCRIPTION

Referring generally to the Figures, the disclosed fuel delivery system may deliver fuel to the intake or directly into the combustion chamber of an internal combustion engine. While the fuel delivery system is described with respect to fuel and internal combustion engines, the disclosed fuel delivery system may be used with other fluids in other applications. For example, the fuel delivery system may be used to spray or inject other liquids, for example, water, beverage, paint, ink, dye, lubricant, scented oil, or other types of fluids.

Before discussing further details of the fuel delivery system and/or the components thereof, it should be noted that references to "top," "bottom," "upward," "downward," "inner," "outer," "right," and "left" in this description are merely used to identify the various elements as they are oriented in the FIGURES. These terms are not meant to limit the element which they describe, as the various elements may be oriented differently in various applications.

Figure 1:
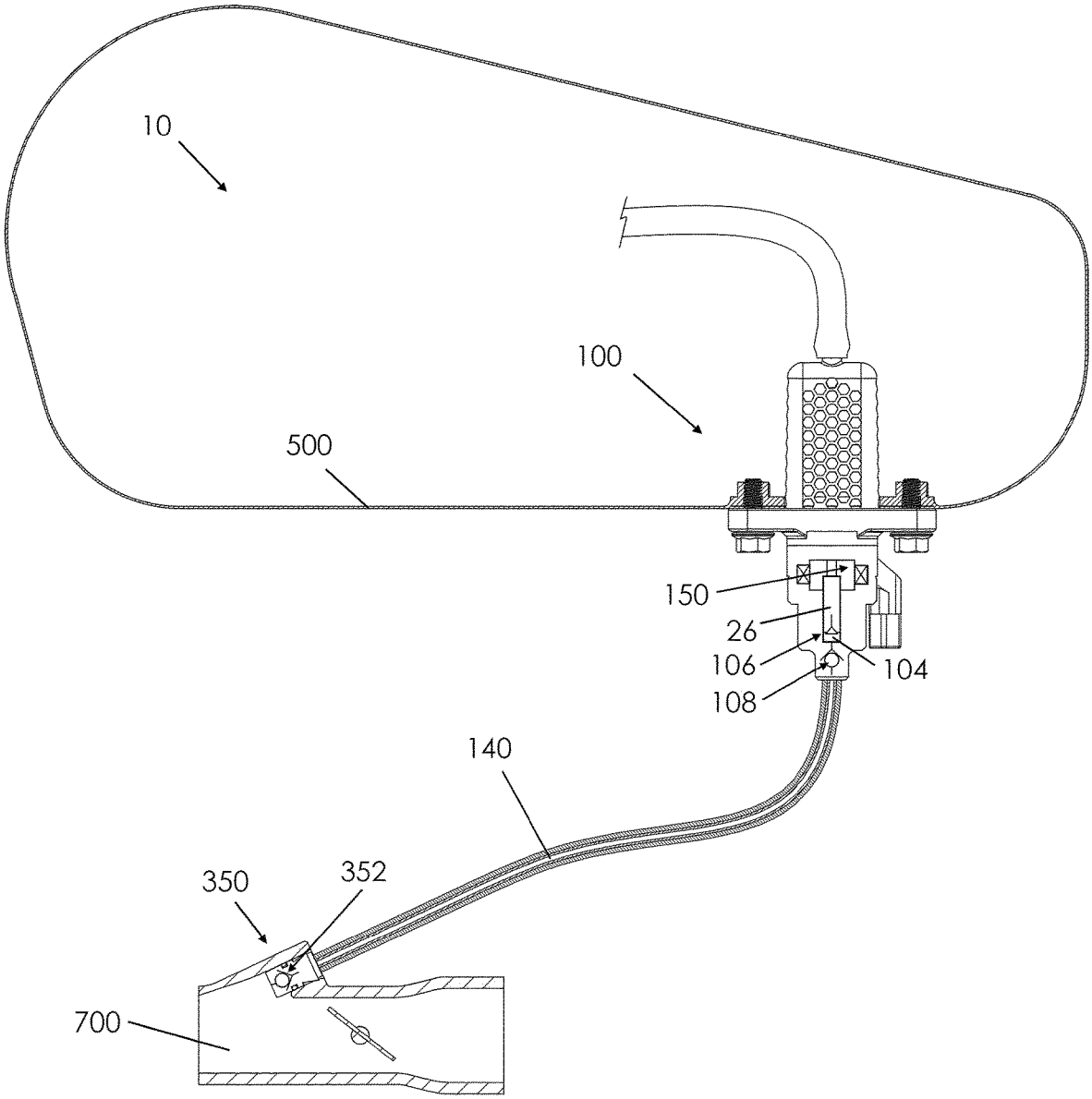
FIG. 1 is a schematic view of a fuel delivery system according to an exemplary embodiment.

Referring to FIG. 1, a fuel delivery system 10 is shown, according to an exemplary embodiment. The fuel delivery system 10 includes a fuel pump assembly 100 and an injection nozzle assembly 350. The fuel pump assembly 100 is shown to include an electromagnetic actuator 150, a piston 26, a pumping chamber 104, an inlet valve 106, and a pump outlet check valve 108. The injection nozzle assembly 350 is shown to include a nozzle check valve 352 and is in fluid communication with the fuel pump assembly 100 via an extension tube 140. The fuel pump assembly 100 is located near the bottom of a fuel tank 500 while the injection nozzle assembly 350 is installed such that the emerging spray is directed into an intake manifold 700.

The operation of the fuel delivery system 10 during an injection cycle is described according to an exemplary embodiment. During the operation of an engine, an electronic control unit (ECU) energizes the electromagnetic actuator 150, which causes the piston 26 to move downwards, closing the inlet valve 106, pressurizing the fuel in the pumping chamber 104, and opening the pump outlet check valve 108. The fuel travels through the extension tube 140 and causes the nozzle check valve 352 to open. The fuel exits the fuel delivery system 10 through the injection nozzle assembly 350 and into the intake manifold 700. After a determined amount of time, the ECU halts the energization of the electromagnetic actuator 150 which stops the downward movement of the piston 26. The pressure in the pumping chamber 104 is consequently reduced and the nozzle check valve 352 and pump outlet check valve 108 both close, stopping the spray of additional fuel into the intake manifold 700. A spring moves piston 26 which opens the inlet valve 106 and allows additional fuel to enter the pumping chamber 104 from the fuel tank 500. The fuel delivery system 10 is primed for a subsequent injection which may be synchronized to the crank position or valve position of an internal combustion engine.

Referring to FIGS. 2-5, a fuel pump assembly 100 and a fuel tank 500 is shown, according to an exemplary embodiment. The fuel pump assembly 100 includes a cap 12 defining a fuel inlet port 14, one or more fuel circulation ports 16, and an internal fuel cavity 17. The fuel inlet port 14 separates the inflow of liquid fuel from the fuel tank 500 to the inlet valve 106 from the fuel in the internal fuel cavity 17. Substantial vapor may be present in the internal fuel cavity 17 due to the movement of the armature 20 and heat generated from a coil 44 and such vapor may exit through the one or more fuel circulation ports 16. The armature 20 is shown to have at least one axial slot 22 to allow for the passage of fuel there through. According to other exemplary embodiments, the armature 20 may include one more additional axial slots to provide for a balanced armature 20. The fuel delivery system 10 further includes a piston 26 positioned adjacent an armature 20. According to the exemplary embodiment, the piston 26 includes a flange 28 that is engaged with the armature 20, such that the piston 26 is permitted to move only in a downward direction by the armature 20. The piston 26 may be otherwise be able to move independently from the armature 20 in other directions, which reduces the transfer of non-axial forces between the armature 20 and piston 26 which may cause wear or binding.

A yoke 40 is coupled to the cap 12. The yoke 40 is configured to receive a bobbin 42 including a coil 44 wound from an enamel wire, according to an exemplary embodiment. The bobbin 42 is shown as being integrally formed with a casing 46 and connector 43. The connector 43 and casing 46 may be formed via an overmolding process to provide retention of the cap 12 with the yoke 40 and sealing for the fuel pump assembly 100, according to an exemplary embodiment. The connector 43 may have pins that permit the connection of coil 44 with an external engine control unit, according to an exemplary embodiment. The yoke 40 is shown to receive a body 60 including a lower body portion 62 and a core portion 70. The core portion 70 and yoke 40 collectively define the stator of the electromagnetic actuator 150. The core portion 70 includes a vertical face 76, which defines a first radial gap 77 relative to an outer periphery of the armature 20 through which a first magnetic field can pass through, such as a first magnetic field line 71 (see FIG. 5). A second radial gap 79 is defined by an inner portion of the yoke 40 and an outer periphery of the armature 20. The core portion 70 includes a tapered face 74 at the periphery of the first radial gap 77. The tapered face 74 converges towards the second radial gap 79.

The core portion 70 includes a horizontal face 78. The horizontal face 78 and a lower surface of the armature 20 define an axial gap 82 through which a second magnetic field can pass through, such as a second magnetic field line 73 (see FIG. 5). The first radial gap 77 and the second radial gap 79 are separated by a non-magnetic material or a cavity such that the magnetic field must pass substantially between the armature 20. The first magnetic field line 71 and the second magnetic field line 73 shown in FIG. 5 can also pass through the second radial gap 79. The lower body portion 62 and the core portion 70 of the body 60 are a unitary structure, according to the exemplary embodiment shown in the figures. According to other exemplary embodiments, the lower body portion 62 and the core portion 70 may be defined by a plurality of bodies coupled together.

An advantage of the armature 20, yoke 40, and core portion 70 disclosed herein is that they collectively provide a relatively constant force when the armature 20 is received within the inside diameter defined by the vertical face 76 of the core portion 70. This flat force characteristic enables the fuel pump assembly 100 to be calibrated more easily by providing a linear flow curve, reduces the part-to-part flow variation of the fuel delivery system, and reduces the fuel flow rate shift during its service life. The constant force characteristic enables the flow rate to be insensitive to the position of the armature 20 with respect to the other components, which may vary from part to part and shift over time due to wear. The design of the core portion 70 design provides a relatively constant force by producing two parallel circuits for the magnetic field. The magnetic field splits into two distinct fields across and first radial gap 77 and the axial gap 82 due to the location of the two gaps at the same end of the armature 20. As the axial gap 82 is reduced by the movement of the armature, a greater portion of the total magnetic field is directed to the first radial gap 77 due to the widening of the tapered face 74, which keeps the force from the magnetic field through the axial gap 82 relatively constant. Furthermore, the magnetic field through the first radial gap 77 produces a comparatively small axial force due to the direction of the field substantially in the radial direction.

According to other exemplary embodiments, the core portion 70 and armature 20 have shapes that provide substantially radial and substantially axial magnetic fields that are parallel circuits between the stator and the armature near the same end of the armature, such that the radial magnetic field strength increases as the axial gap is reduced. For example the tapered face 74 may be replaced by a step so that the average field through radial gap is increased as the axial gap is reduced. The cone portion may be also located on the armature instead of the core. The lower face of the armature and upper face of the core may also assume a matching tapered face so that the axial gap is conical, which may provide an even more constant force through the range of travel of the actuator.

The yoke 40 can receive an armature sleeve 45 in which the armature 20 is slidingly received. The armature sleeve 45 can, advantageously, improve the useful life of the armature 20 and reduce the sideways force experienced by the armature. The armature 20, yoke 40, and core portion 70 may be made out of a magnetically permeable material or combination of materials, while the piston 26 and armature sleeve 45 may be made out of a material with a high magnetic reluctance, according to an exemplary embodiment. According to an exemplary embodiment, the armature sleeve 45 may be fabricated with the yoke 40 out of a single piece and the inside diameter of the armature sleeve 45 may be plated with a high magnetic reluctance material of sufficient thickness such as nickel. According to another embodiment, the armature sleeve 45 may be uncoated while the armature 20 may have a high magnetic reluctance material plated on its periphery. The armature 20, piston 26, yoke 40, bobbin 42, coil 44, and core portion 70 are axisymmetric and shown aligned along a central axis "A". When the coil 44 is energized by an external driver, such as an engine control unit, the interaction of the coil 44, armature 20, yoke 40, and core portion 70 produces a force causing the armature 20 and the piston 26 to move in a downward direction towards the core portion 70, thereby reducing the axial gap 82. According to other embodiments, a different type of actuator than the electromagnetic actuator 150 may be used such as other solenoid actuator topologies, a moving magnet actuator, or voice coil actuator.

A damping boss 50 in the cap 12 is shown to be received by a damping recess 52 in the armature 20 defining a damping chamber 51 when the armature 20 is near the top of its travel, according to an exemplary embodiment. When the armature 20 is traveling upwards at the end of the upward stroke, the volume of the damping chamber 51 is reduced which causes the fuel therein to pressurize which decelerates the armature 20 and reduces its impact on the cap 12. According to the exemplary embodiment, the cap 12 is shown to be receiving a damping member 54 which impacts the top face of the armature to reduce impact. The damping member 54 is preferably resilient by material or geometric design such as a number of dimples or spring washer. According to another embodiment, the electromagnetic actuator 150 may be energized near the predicted end of the upward travel of the armature 20 which will decelerate the armature 20 and reduce its impact on the cap 12.

A main spring 80 is sandwiched between the bottom of the flange 28 and the body 60. According to the exemplary embodiment, the main spring 80 is conical and is engaged with the outside diameter of the piston 26 and the inside diameter of a groove 81 in the body 60 so that the main spring 80 does not contact the piston 26 during its range of motion. The main spring 80 biases the piston 26 upwards according to the exemplary embodiment. According to another exemplary embodiment, the main spring 80 can bias the piston 26 towards the pump outlet check valve 108. The upstroke or suction stroke of the piston 26 is initiated completely by the force produced by energizing an electromagnetic actuator; whereas, the down stroke of the piston 26 can be powered by the main spring 80 (i.e., via the bias or return force of the spring). According to the embodiment shown, the piston 26 includes a substantially cylindrical wall having a first or top end, proximate the cap 12, and a second or bottom end, distal a pump outlet check valve 108. The piston wall defines a longitudinal piston cavity through which fluid passes during the piston pumping cycle, i.e., the injection cycle. The bottom end of the piston 26 is shown to include an inlet valve seat 32 formed in the bottom end of the piston 26. The piston 26 is received in a piston bore 64 formed in the body 60. A pumping chamber 104 is defined by the bottom end of the piston 26, the piston bore 64, and the top face of the outlet valve seat block 101.

An inlet valve 106 is located at the bottom end of the piston 26 according to an exemplary embodiment. The inlet valve 106 includes an inlet valve body 122 formed with an inlet valve stem 124, an inlet valve retainer 126, and an inlet valve spring 128. The inlet valve body 122 seals against the inlet valve seat 32. The inlet valve stem 124 is coupled to the inlet valve retainer 126. The inlet valve retainer 126 has at least one channel such as channel 125 to allow the passage of fuel into the pumping chamber 104. The inlet valve body 122 and the inlet valve seat 32 are both shown to have a tapered shape to provide self-alignment and improved sealing. The poppet design of the inlet valve 106 of the exemplary embodiment provides a low volume of the pumping chamber 104 when the piston 26 is at the bottom of its travel, which improves high temperature operation of the fuel pump assembly 100. According to another exemplary embodiment, the inlet valve 106 may be of another type other than the poppet design. For example, the inlet valve body 122 may be a sphere, flat plate, or reed. The inlet valve retainer 126 is received by, and axially translates within, the piston cavity. The inlet valve retainer 126 is attached to the inlet valve stem 124 and limits the travel of the inlet valve through contact of the shelf 127 on the inside of the piston 26. The inlet valve spring 128 is shown to bias the inlet valve 106 into an open position. According to another exemplary embodiment, the inlet valve spring 128 may bias the inlet valve 106 into a closed position or the inlet valve spring 128 may be omitted.

An advantage of an open inlet valve at the start of the injection cycle achieved by biasing of a spring member or by the momentum of the inlet valve body 122 is that any vapor present in the pumping chamber 104 is allowed to exit or be expelled therefrom. Another advantage of an open inlet valve at the start of injection is the current through the coil 44 can be used by the processing electronics to discern the amount of fluid available in the pumping chamber 104. This can, advantageously, be used to adjust the pulse width or prevent damage to the fuel pump assembly 100 when there is a lower than normal amount of fuel in the pumping chamber 104.

A pump outlet check valve 108 is shown to be at or near a bottom of the lower body portion 62, according to an exemplary embodiment. The piston 26 or inlet valve body 122 can, at the end their travel, abut the top face of the outlet valve seat block 101. The piston 26 may reach the end of its travel before the axial gap 82 reaches zero, preventing the yoke 40, armature 20, and core portion 70 from retaining permanent magnetism. The pump outlet check valve 108 includes an outlet valve seat 102, sealing O-ring 103, an outlet valve body 105 (e.g., ball, check, etc.), an outlet valve spring 107, and a plate 109. The outlet valve body 105 is biased towards the outlet valve seat 102 by the outlet valve spring 107 which is supported by the plate 109 and aligned by an indent 110 formed on the plate 109. One or more holes 112 on the plate 109 allow fuel to pass through to a fuel pump barb 130 and into the extension tube 140 once the outlet valve body 105 is separated from the outlet valve seat 102 (i.e. pump outlet check valve is open). According to the exemplary embodiment shown, the outlet valve body 105 is a polished sphere and the outlet valve seat 102 has a conical sealing surface, thereby ensuring self-alignment and a good seal. The sealing surface on the outlet valve seat 102 may be formed by coining to provide a reliable seal while reducing manufacturing costs. The fuel pump barb 130 has a ring feature 132 which improves the sealing to the extension tube 140. According to the exemplary embodiment, an extender sheath 218 encapsulates the extension tube 140 and provides heat insulation and protection against abrasion and excessive bending.

According to the exemplary embodiment shown, the flange 118 is formed to retain the outlet check valve assembly components. According to other exemplary embodiments, the pump outlet check valve 108 may be affixed by other means, such as through a retaining ring. According to other exemplary embodiments, outlet check valve designs other than those described above and shown in FIGS. 2-5 may also be used with the fuel delivery system 10. For example, the outlet valve body 105 can have a variety of shapes, for example, flat plate, conical, poppet, mushroom, semi-spherical, etc. The outlet valve spring 107 can also be a resilient planar member, a spring washer, a solid flexible member, a conical helical spring, or the like.

According to an exemplary embodiment, an insulation jacket 160 is shown to encapsulate the outside of the lower body portion 62 and defines an air space 162. The insulation jacket 160 and air space 162 reduces the transfer of heat from engine components into the fuel pump assembly 100 which can increase evaporative emissions and cause vapor lock. According to the exemplary embodiment, the insulation jacket 160 is affixed to the yoke 40 with locking tab 164 and has an internal clamp 166 that provides external pressure on the extension tube 140 to prevent its separation from the fuel pump barb 130.

According to an exemplary embodiment, the cap 12 is attached to the bottom of the fuel tank 500 via two mounting screws 168. The cap gasket 170 provides sealing between the fuel tank and the cap 12. According to another exemplary embodiment, the cap gasket 170 may be a thin sheet of resilient material such as an elastomer to reduce the transfer of impact energy from the fuel pump assembly 100 to the fuel tank 500, which may cause the fuel tank 500 to reverberate and increase operation noise. A filter basket 172 is attached to the cap 12 and prevents the ingress of debris from the fuel tank 500 into the fuel pump assembly 100. According to an exemplary embodiment, a vent tube 174 on the top of the filter basket 172 allows the exit of fuel vapor from inside the filter basket 172 to the fuel tank. The vent tube 174 may be connected to an evaporative canister that absorbs gaseous hydrocarbons.

Figure 2:
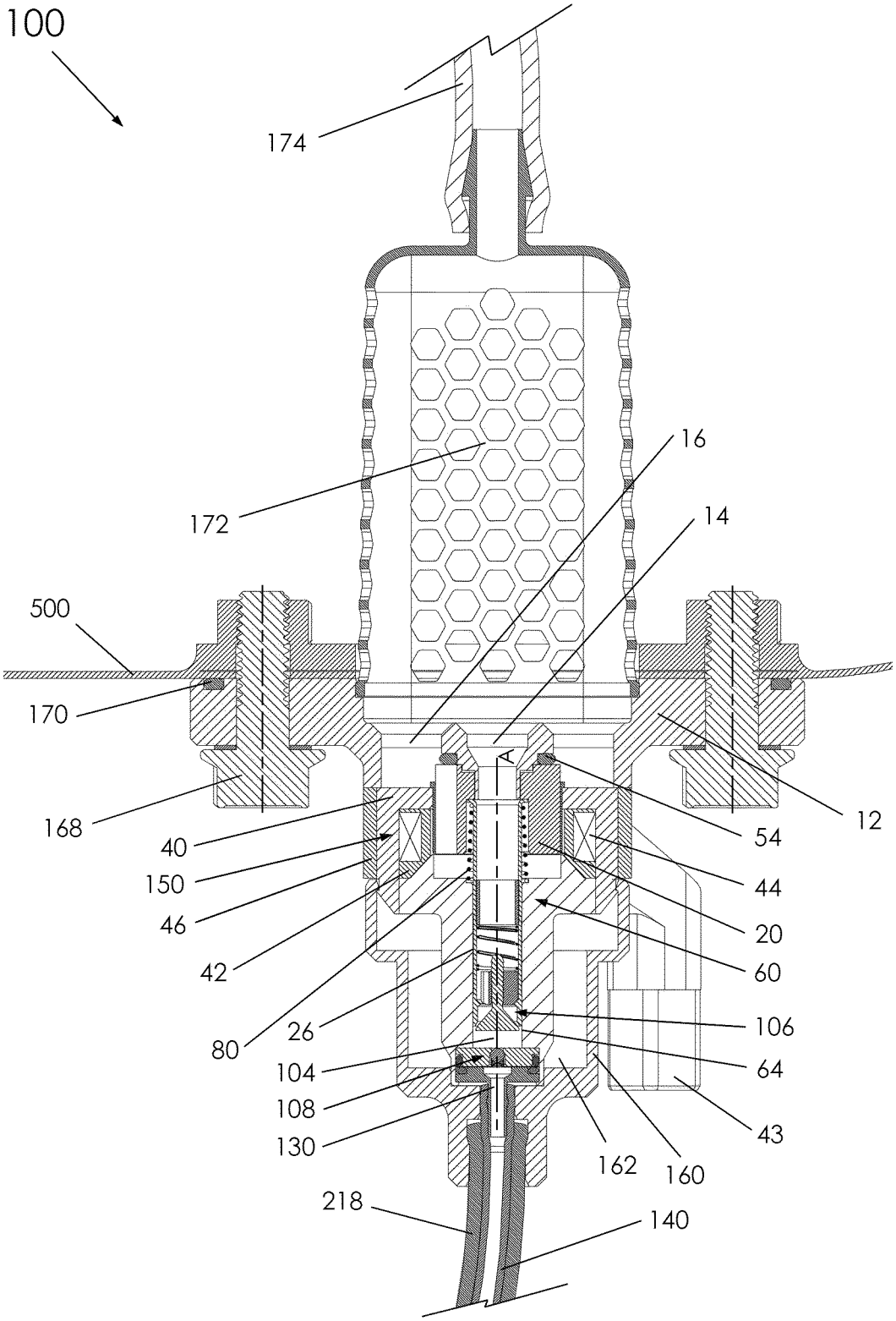
FIG. 2. is a cross-sectional view of the fuel pump assembly of the fuel delivery system of FIG. 1.
Figure 3:
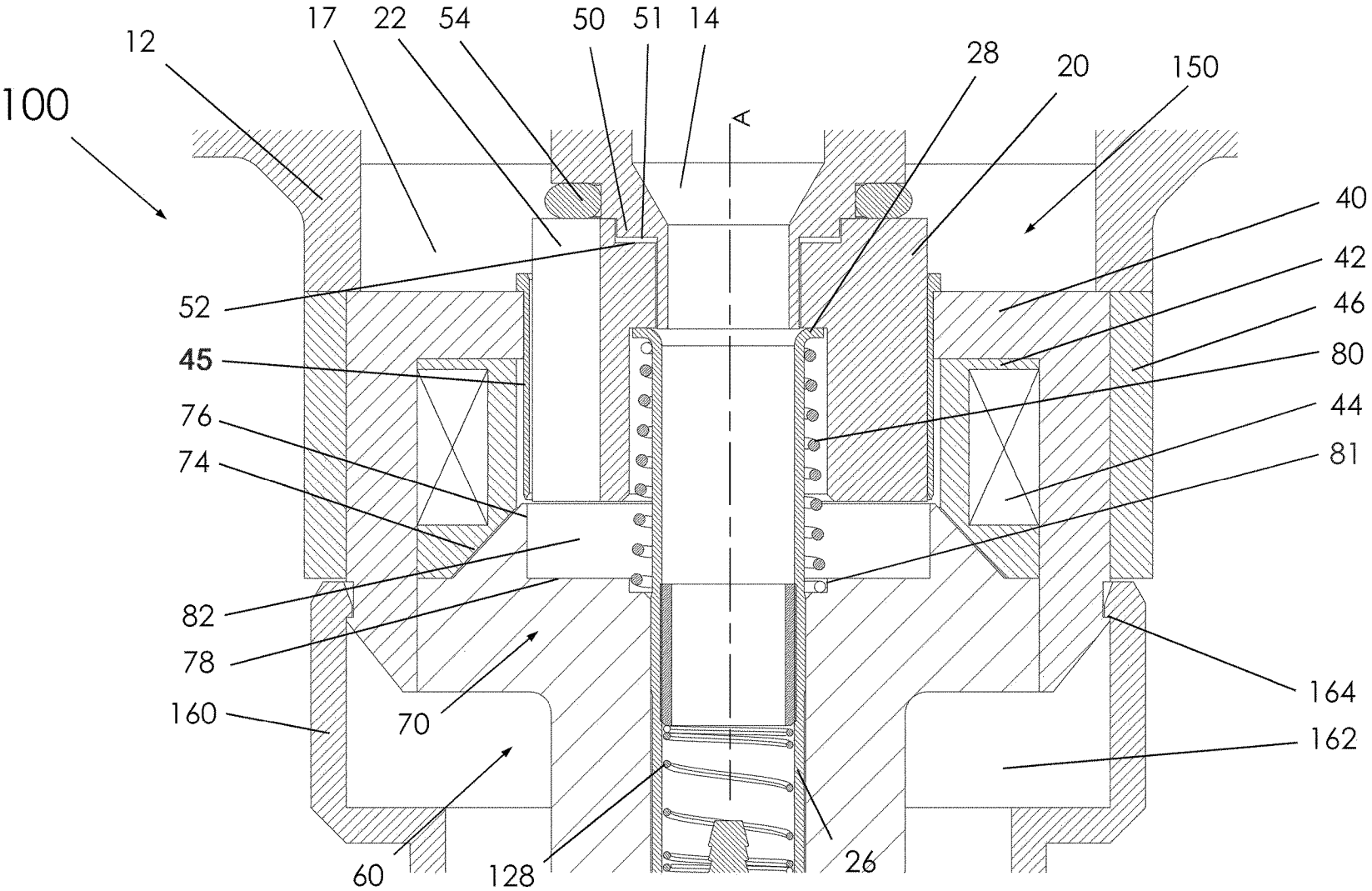
FIG. 3. is a cross-sectional view of the electromagnetic actuator of the fuel pump assembly of FIG. 2.
Figure 4:
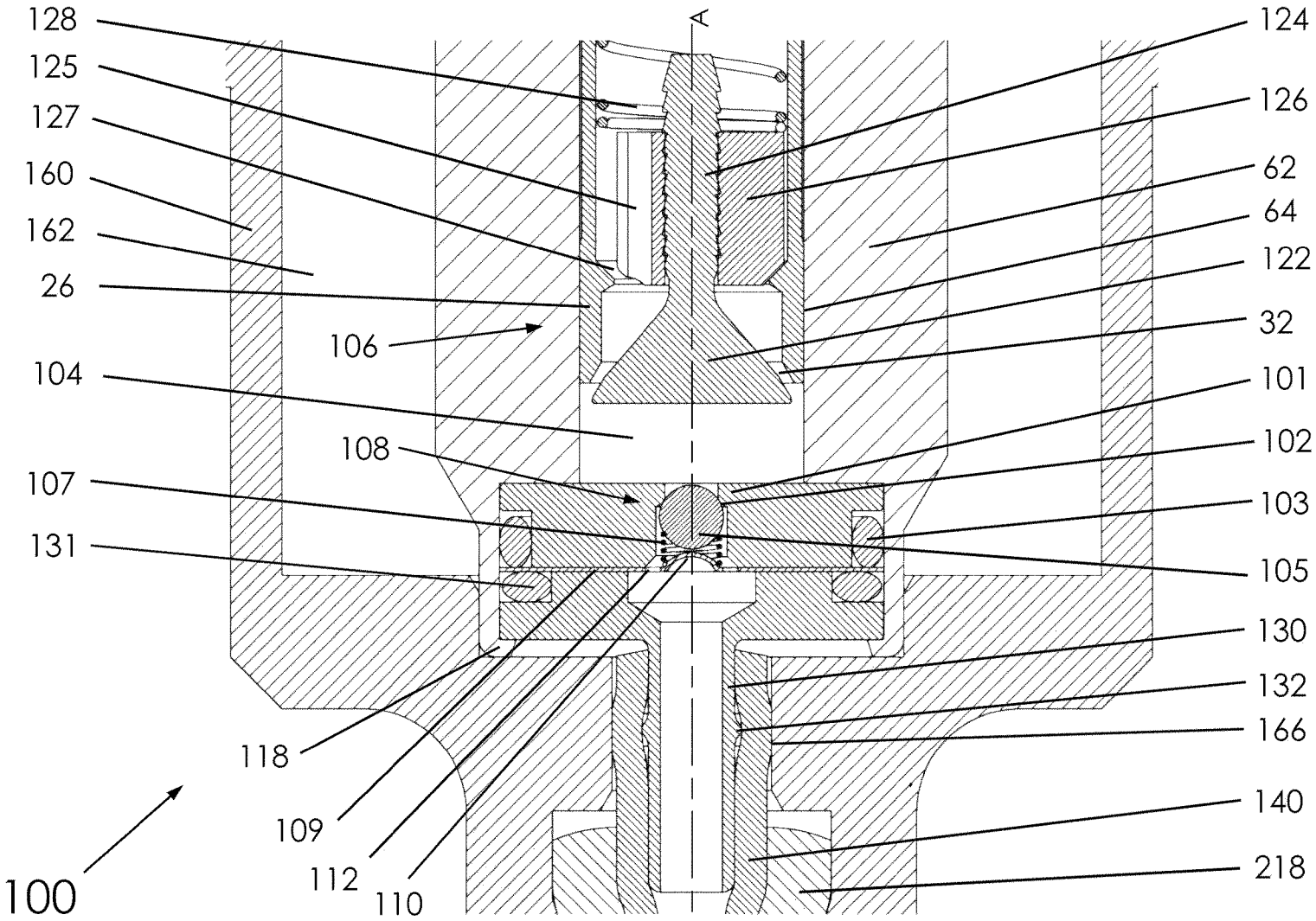
FIG. 4. is a cross-sectional view of the inlet valve and pump check valve of the fuel pump assembly of FIG. 2.
Figure 5:
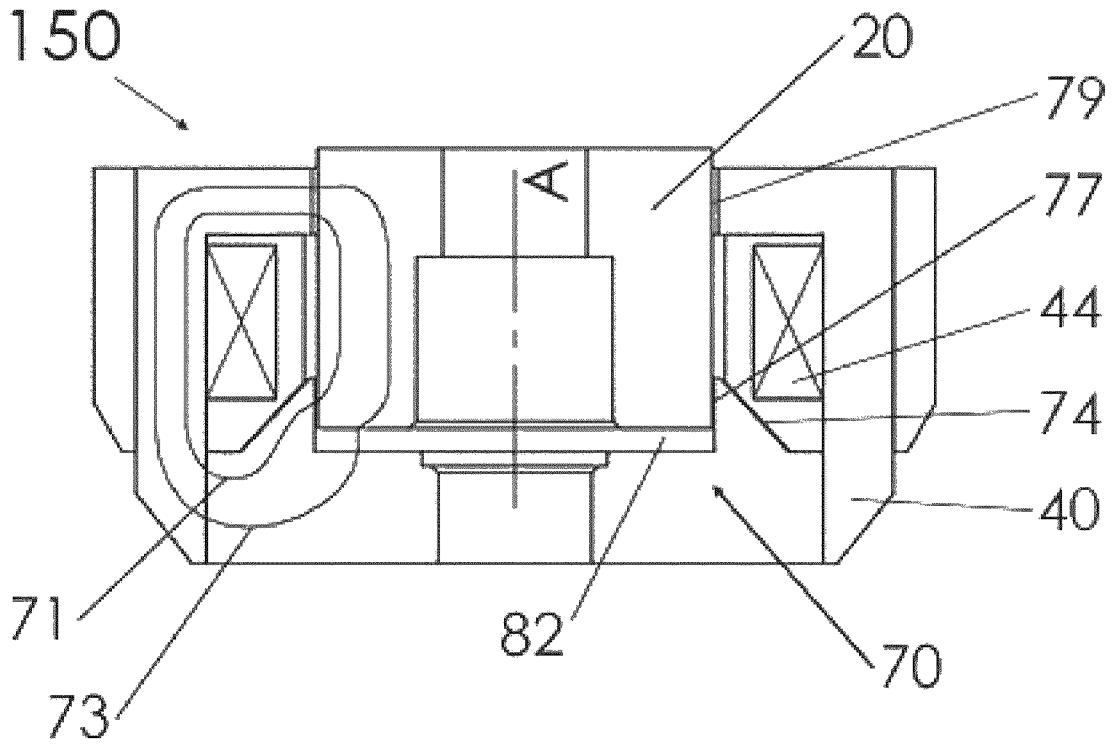
FIG. 5. is a cross-sectional view of the electromagnetic actuator of the fuel pump assembly of FIG. 2.

A piston pumping cycle is described, according to an exemplary embodiment. As shown in FIG. 2-4, at the start of an injection event, the armature 20 is biased by the main spring 80 to a first or top position against the cap 12 or damping member 54. The engine control unit creates a sufficient current in the coil 44 which produces a downward force on the armature 20 and a subsequent downward motion of the piston 26 to reduce the volume of the pumping chamber 104 and reduce the axial gap 82. Fuel present in the axial gap 82 can enter the internal fuel cavity 17 through the axial slot 22 on the armature 20 so that it can continue to travel downwards without substantial impediment. When the inlet valve 106 closes, the downward motion of the piston 26 generates a rapid increase in pressure in the pumping chamber 104, which causes the outlet valve body 105 to move away from the outlet valve seat 102 and the pump outlet check valve 108 to open. Fluid can move through the one or more holes 112 and exit the pump outlet check valve 108 through the fuel pump barb 130 and into the extension tube 140.

When the current through the coil 44 is stopped by the processing electronics, the piston 26 loses velocity which causes the fluid pressure in the pumping chamber 104 to drop and the pump outlet check valve 108 to close. The closing of the pump outlet check valve 108 marks the end of an injection cycle of the fuel pump assembly 100. The main spring 80 can push the piston 26 and armature 20 upwards. The inlet valve 106 can then open due to relative negative pressure generated in the pumping chamber 104 by the movement of the piston 26, by the force of the inlet valve spring 128, by the upward motion of the piston 26 and momentum of the inlet valve body 122, or a combination of the three. Fuel can enter the pumping chamber 104 via the inlet valve 106, and the fuel pump assembly 100 is primed for subsequent injections. According to an exemplary embodiment, the fuel inlet port 14 is aligned with axis A so that fuel directed towards the fuel delivery system 10 is introduced directly into the cavity in the piston 26, and eventually the pumping chamber 104 through the inlet valve 106. Vapor generated in the fuel delivery system 10 may exit through the fuel circulation port 16 through buoyancy or a secondary pump (not shown).

Figure 6:
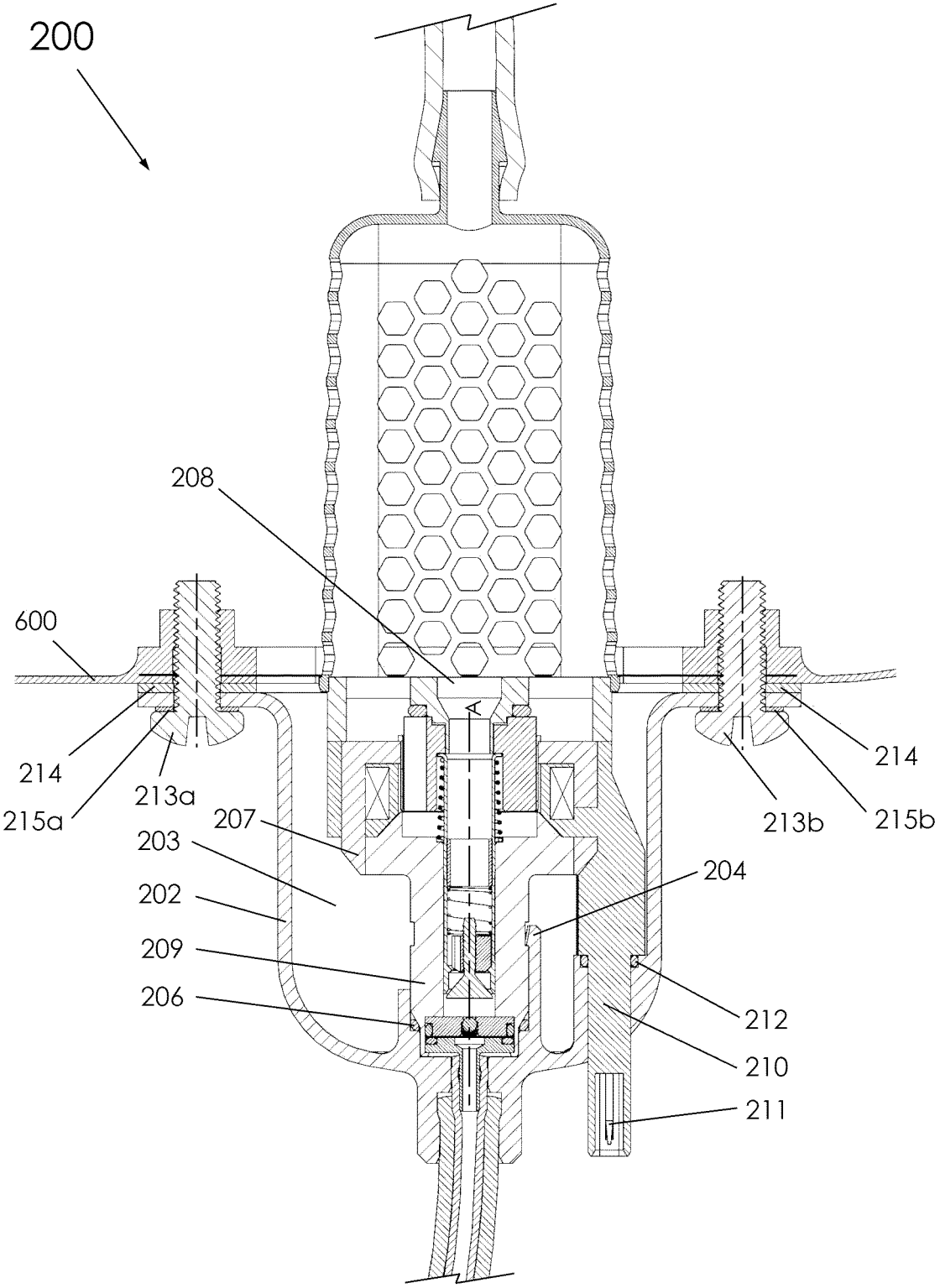
FIG. 6. is a cross-sectional view of the fuel pump assembly of a fuel delivery system of FIG. 1 according to another exemplary embodiment.

Referring to FIG. 6, a fuel pump assembly 200 and a fuel tank 600 is shown, according to another exemplary embodiment. The fuel pump assembly 200 includes the same components and method of operation as the fuel pump assembly 100, except it is submerged in the bottom of the fuel tank 600 and omits the insulation jacket 160 and accompanying air space 162 of the fuel pump assembly 100. The different components will be described.

According to an exemplary embodiment, the fuel pump assembly 200 is attached to the fuel tank 600 via a fuel well 202 which has a fuel cavity 203. The fuel well 202 has a locking feature 204 which mates to the body 209 of the fuel pump assembly 200 and provides sealing thereof via O-ring 206. The fuel pump assembly 200 has a fuel inlet 208 that is at the same level or below the bottom surface of the fuel tank 600 so the entire capacity of the fuel tank 600 can be used. According to one embodiment, a fuel pump assembly connector 210 passes through the fuel well 202 via through-wall seal 212 and may be connected electrically to an external engine control unit through at connector pins such as connector pin 211. In one embodiment, the fuel well 202 is coupled to the fuel tank 600 with bolts 213*a* and 213*b*, a resilient tank seal 214, and bolt seals 215*a* and 215*b* which together reduce the impact energy transmitted from the fuel pump assembly 200 to the fuel tank 600 and provides sealing of the interface. An advantage of the fuel pump assembly 200 and fuel well 202 is that it provides substantial cooling of the fuel pump assembly 200 and provides insulation from the heat emitted by engine components by virtue of the fuel in the cavity 203. The fuel in the cavity 203 is in contact with, and provides substantial heat transfer with the yoke 207 and the body 209.

Figure 7:
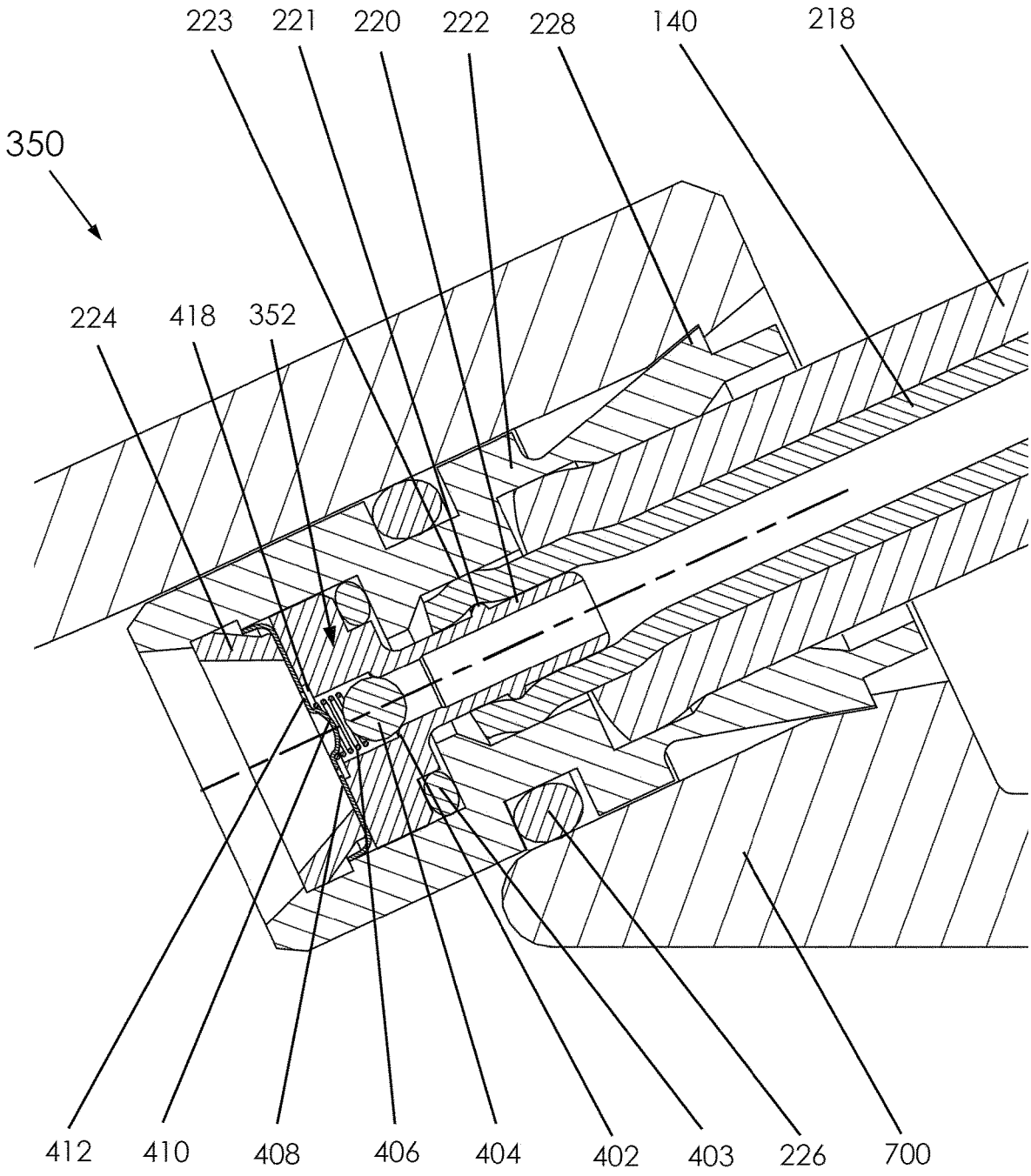
FIG. 7. is a cross-sectional view of the injection nozzle assembly of a fuel delivery system of FIG. 1.

Referring to FIG. 7, an injection nozzle assembly 350 is shown, according to an exemplary embodiment. An extension tube 140 provides fluid communication between a fuel pump assembly such as the exemplary fuel pump assembly 100 or fuel pump assembly 200 and the described injection nozzle assembly 350. Preferably the internal diameter of the extension tube 140 is as small as possible to reduce internal volume without excessively restricting flow. The small internal volume reduces the priming requirements of the system after all of the fuel inside the fuel tank 600 has been expelled. According to the exemplary embodiment, the extension tube 140 is coupled to a fuel pump barb 130 on the fuel entrance side and a nozzle barb 220 on the fuel exit side. A ring feature 221 on the nozzle barb 220 improves sealing and an internal radius clamp 223 on a nozzle body 222 reduces the likelihood of the extension tube 140 separating from the injection nozzle assembly 350. According to another embodiment, the extension tube 140 may be welded directly to an injection nozzle body 222. A nozzle check valve 352 is located immediately downstream of the nozzle barb 220 and includes a nozzle valve seat 402, a sealing O-ring 403, a nozzle valve body 404 (e.g., ball, check, etc.), a nozzle valve spring 406, and a plate 408. The nozzle valve body 404 is biased towards the nozzle valve seat 402 by the nozzle valve spring 406 which is supported by the plate 408 and aligned by an indent 410 formed on the plate 408. One or more orifices 412 on the plate 408 allow fuel to exit the injection nozzle assembly 350 ideally in an atomized state once the nozzle valve body 404 is separated from the nozzle valve seat 402 (i.e. nozzle check valve is open). According to the exemplary embodiment shown, the nozzle valve body 404 is a polished sphere and the nozzle valve seat 402 has a conical sealing surface, thereby ensuring self-alignment and a good seal. The sealing surface on the nozzle valve seat 402 may be formed by coining to provide a reliable seal while reducing manufacturing costs. According to the embodiment shown, a step 418 formed in the nozzle valve seat 402 provides a turbulent path for the fuel which increases atomization. According to other embodiments, the step 418 may assume other shapes such as a cone to affect the spray pattern of the injection nozzle assembly 350.

The nozzle valve body 404 and nozzle valve spring 406 may be advantageously kept small in size in order to reduce the volume of the fluid between the nozzle valve seat 402 and the plate 408. This volume of the fluid is known as the "sac-volume", from which gasoline may evaporate or drip into the intake manifold 700 not during injection which can increase engine emissions. In contrary, the outlet valve body 105 and outlet valve spring 107 inside the fuel pump assembly 100 may be larger in comparison since the volume of fluid after the outlet valve seat 102 and before the nozzle valve seat 402 is sealed. As a result of keeping the outlet valve body 105 and outlet valve spring 107 larger in size, the flow restriction and part-to-part variation in the pump outlet check valve 108 may be reduced compared to the nozzle check valve 352.

During heat soak of the engine, the injection nozzle 350 and extension tube 140 may increase substantially in temperature which will increase the pressure of the fuel between the nozzle check valve 352 and pump outlet valve 108. Leakage through the two valves must be kept minimal otherwise a portion of the fuel contained in between may become vaporized and cause the fuel delivery system 10 to lose its prime and require additional travel or cycles of the piston 26 before fuel exits the injection nozzle 350 once an attempt is made to restart the engine. The preload of the nozzle valve spring 406 may be advantageously made higher than the outlet valve spring 107 so that the nozzle check valve 352 provides better sealing than the pump outlet valve 108 at low pressures. The aforementioned may be employed because the seal of the nozzle check valve 352 will deteriorate with increasing pressure in the extension tube 140 during heat soak whereas the seal of the pump outlet valve 108 will improve.

According to the exemplary embodiment, the nozzle components are retained by a snap-in nozzle retainer 224. According to other exemplary embodiments, the injection nozzle components may be retained by other means such as heat staking of the injection nozzle body 222 or a retaining ring. According to other exemplary embodiments, nozzle check valve designs other than those described above and shown in FIGS. 1 and 2 may also be used with the injection nozzle assembly 350. For example, the nozzle valve body 404 can have a variety of shapes, for example, flat plate, conical, poppet, mushroom, semi-spherical, etc. The nozzle valve spring 406 can also be a resilient planar member, a spring washer, a solid flexible member, a conical helical spring, or the like. According to an exemplary embodiment, the injection nozzle body 222 is coupled to an intake manifold 700 and is sealed by an external O-ring 226 and mechanically fixed by a snap-in feature 228.

Traditional fuel injection systems is comprised of a fuel pump which provides a constant high pressure to the fuel injector which acts as an on-off valve to deliver fuel to the engine. A low-cost type of fuel delivery system may not use a separate fuel pump and injector but instead only one actuator to pressurize, meter, and deliver fuel to the engine on demand. A major challenge of on-demand pressurization is that the fuel is at or near atmospheric pressure and will boil and cause vapor locking of the fuel delivery system. An advantage of the present invention is that the fuel pressurization components are located away from locations which are typically much hotter than the fuel tank. Furthermore, mounting the fuel pressurization components close to the tank absolves the use of fuel lines and improves the natural convective flow of fuel and vapor from the fuel tank to the fuel pump assembly to improve cooling. Additionally, the injection nozzle does not contain any actuators and can be made smaller than a traditional fuel injector which increases the mounting flexibility and potentially provide improved fuel targeting to reduce emissions. On small engine applications, the fuel tank is typically located close to the point of injection which allows the use of a short extender tube and reduce the priming time of the system when previously void of fuel.

The check valve components can be a source of flow variation is manufacturing. Through the use of two check valves on the pump assembly and injection assembly, the two valves may be matched to provide a more consistent total fuel delivery system flow rate. For example, a fuel pump assembly with a higher than normal flow rate can be combined with an injection nozzle assembly with a lower than normal flow rate so that the flow variations in both components cancel the other out. Another possibility of using an injection nozzle assembly separate from the pressurization assembly is that multiple cylinder engines may be operated with one pressurization assembly by using one injection nozzle assembly for each cylinder and diverting the flow from the pressurization assembly.

The particular topology of the electromagnetic actuator in the embodiment of the present invention provides a relatively constant force through its travel while being low in cost compared to for example moving magnet actuators or voice coil actuators. The lack of a magnet in this type of actuator also reduces the likelihood of actuator damage from overheating due to demagnetization of the permanent magnet. The constant force characteristic of this type of actuator provides reduced part-to-part variation during production and reduces the change in flow rate over the lifetime of the fuel delivery system.

When the moving components of the fuel pump assembly returns to its rest state, they will impact against a stationary portion of the fuel pump assembly and generate noise. When the fuel pump assembly is affixed to a fuel tank, particularly of metal construction, the noise can be amplified by reverberation of the tank. The impact damping means of the present invention reduces the operating noise of the fuel delivery system.

The construction and arrangement of the elements of the fuel injection system as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. The elements and assemblies may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments.

The order or sequence of any process or method steps may be varied or re-sequenced according to alternative embodiments. Any means-plus-function clause is intended to cover the structures described herein as performing the recited function and not only structural equivalents, but also equivalent structures. Other substitutions, modifications, changes and omissions may be made in the design, operating configuration, and arrangement of the preferred and other exemplary embodiments.

What is claimed is:

1. A fuel delivery system, comprising:

a fuel pump assembly, the fuel pump assembly including:

a pumping chamber;

an inlet valve configured to direct fuel to the pumping chamber;

a piston configured to pressurize fuel in the pumping chamber;

an electromagnetic actuator operatively coupled to the piston; and a pump outlet check valve configured to direct pressurized fuel out of the pumping chamber;

wherein the electromagnetic actuator is configured to produce a force sufficient to move the piston to pressurize fuel in the pumping chamber and direct pressurized fuel through the pump outlet check valve;

an extension tube located downstream of the pump outlet check valve and the fuel pump assembly;

a fuel pump barb positioned between the outlet check valve and the extension tube, the fuel pump barb engaging the extension tube to couple the extension tube to the fuel pump assembly; and an injection nozzle assembly located downstream of the extension tube and the fuel pump assembly, wherein the injection nozzle assembly includes a nozzle check valve configured to selectively permit pressurized fuel received from the pump outlet check valve through the extension tube to exit the fuel delivery system.

2. The fuel delivery system of claim 1, wherein the fuel pump assembly is configured to be located in a fuel tank.

3. The fuel delivery system of claim 2, wherein the fuel pump assembly includes a casing configured to be substantially submerged in a volume of fuel in the fuel tank.

4. The fuel delivery system of claim 1, wherein the injection nozzle assembly is configured to deliver fuel into an intake of an internal combustion engine.

5. The fuel delivery system of claim 1, wherein the electromagnetic actuator is a voice coil actuator.

6. The fuel delivery system of claim 1, wherein the electromagnetic actuator includes a coil, an armature, and a stator, wherein the armature and the stator cooperatively define a radial and an axial gap therebetween, and wherein the electromagnetic actuator is configured to produce a magnetic field that passes through both the radial and axial gaps.

7. The fuel delivery system of claim 1, wherein the injection nozzle assembly includes a plate including at least one orifice to allow fuel to exit the fuel delivery system.

8. The fuel delivery system of claim 1, wherein the pump outlet check valve includes a ball-shaped outlet valve body.

9. The fuel delivery system of claim 1, wherein the nozzle check valve includes a ball-shaped outlet valve body.

10. The fuel delivery system of claim 1, wherein the fuel pump assembly includes an insulation jacket.

11. The fuel delivery system of claim 1, wherein the inlet valve has a poppet-shaped valve body.

12. A fuel delivery system, comprising:

a fuel pump assembly, including:

a pumping chamber;

an inlet valve configured to introduce fuel into the pumping chamber;

a piston configured to pressurize fuel in the pumping chamber;

an electromagnetic actuator configured to move the piston; and an outlet check valve for directing pressurized fuel out of the pumping chamber;

wherein the inlet valve is configured to be in an open position during an intake stroke of the piston to introduce fuel into the pumping chamber; and wherein the piston is configured to pressurize fuel in the pumping chamber during a pumping stroke of the piston to cause the outlet check valve to open and the inlet valve to close;

an extension tube located downstream of the outlet check valve and the fuel pump assembly;

a fuel pump barb positioned between the outlet check valve and the extension tube, the fuel pump barb engaging the extension tube to couple the extension tube to the fuel pump assembly; and an injection nozzle assembly including a nozzle check valve located downstream of the extension tube and the fuel pump assembly;

wherein the fuel pump barb, the extension tube, and the nozzle check valve are configured to direct pressurized fuel received from the outlet check valve into an intake of an engine.

13. The fuel delivery system of claim 12, wherein the fuel pump assembly is configured to be located in a fuel tank.

14. The fuel delivery system of claim 12, wherein the electromagnetic actuator is a voice coil actuator.

15. The fuel delivery system of claim 12, wherein the electromagnetic actuator includes a coil, an armature, and a stator, wherein the armature and the stator cooperatively define a radial and an axial gap therebetween, and wherein the electromagnetic actuator is configured to produce a magnetic field that passes through both the radial and axial gaps.

16. The fuel delivery system of claim 12, wherein the injection nozzle assembly includes a plate including at least one orifice to allow fuel to exit the fuel delivery system.

17. The fuel delivery system of claim 12, wherein at least one of the outlet check valve and the nozzle check valve includes a ball-shaped outlet valve body.

18. The fuel delivery system of claim 12, wherein the fuel pump assembly includes an insulation jacket.

19. The fuel delivery system of claim 12, wherein the inlet valve has a poppet-shaped valve body.

20. A fuel delivery system, comprising:

a fuel pump assembly, including:

a pumping chamber;

an inlet valve configured to introduce fuel into the pumping chamber;

a piston configured to pressurize fuel in the pumping chamber; and an outlet check valve configured to direct pressurized fuel out of the pumping chamber;

an extension tube located downstream of the outlet check valve and the fuel pump assembly;

a fuel pump barb positioned between the outlet check valve and the extension tube, the fuel pump barb engaging the extension tube to couple the extension tube to the fuel pump assembly; and an injection nozzle assembly including a nozzle check valve located downstream of the extension tube and the fuel pump assembly;

wherein the fuel pump barb, the extension tube, and the nozzle check valve are configured to direct pressurized fuel received from the outlet check valve into an intake of an engine.

* * * * *